US005997332A

United States Patent [19]

Choy

[11] Patent Number: 5,997,332

[45] Date of Patent: Dec. 7, 1999

[54] CONNECTOR WITH LATCH DEVICE

[75] Inventor: Edmond Choy, Union City, Calif.

[73] Assignee: Hon Hai Precision Ind. Co., Ltd., Taipei Hsien, Taiwan

[21] Appl. No.: 09/207,696

[22] Filed: Dec. 8, 1998

Related U.S. Application Data

[63] Continuation-in-part of application No. 09/041,879, Mar. 12, 1998.

[51] Int. Cl.[6] ..... H01R 13/62

[52] U.S. Cl. ..... 439/328

[58] Field of Search ..... 439/327, 326, 439/328, 329, 152–160, 630–637, 541.5

[56] References Cited

U.S. PATENT DOCUMENTS 5,203,714 4/1993 Tuan ..... 439/326

*Primary Examiner*—Lincoln Donovan
*Assistant Examiner*—Eugene G. Byrd
*Attorney, Agent, or Firm*—Wei Te Chung

[57] ABSTRACT

An electrical connector includes an elongate insulative housing defining a central slot for receiving a module therein. latch device is positioned at each end of the housing. Each latch device includes a plastic member integrally extending from the housing, and a metal member cooperating with the plastic ember. A first plate of the metal member abuts against an outer surface of the plastic member and a first tang extending from the first plate, incorporates the first plate to confine the plastic member therebetween. The module can be released from the connector by applying an outward force to free ends of the latch devices. A second tang extending from the first plate abuts against the plastic member when the latch device reaches its outermost position thereby preventing over-extension and breakage thereof. A third tang downwardly extending from the first plate is received in a recess defined in an outer surface of the plastic member for limiting inward movement of the latch device thereby further preventing breakage thereof.

15 Claims, 4 Drawing Sheets

CONNECTOR WITH LATCH DEVICE

The present invention is a continuation in part of U.S. application Ser. No. 09/041,879 filed on Mar. 12, 1998.

BACKGROUND OF THE INVENTION

1. Field of The Invention

The present invention relates to an electrical connector having a latch device including a plastic member and a metal member in cooperation with each other for releasably securing a printed circuit board thereto.

2. The Related Art

U.S. Pat. Nos. 5,759,057 and 5,755,585 disclose SO DIMMs (Small Outline Dual In-line memory modules). The former discloses a latch device essentially consisting of a plastic member and a metal member, and the latter discloses a high profile design.

The integrally formed plastic member is used to retain a clipping portion of a daughter board and the metal member is used to release the daughter board from the plastic member. The metal member is separated from the housing. However, even though such latches provide improved resilience and strength, the plastic member tends to break when an excess force is exerted thereon.

In order to prevent the plastic member from breaking, the housing is provided with a stopper to limit movement of the plastic member. This inevitably increases the length of the connector and hinders the compactness thereof. In addition, plastic stoppers are not durable thereby hindering resilience of the plastic member. Furthermore, in locking or releasing the daughter board, the hybrid latches are pushed away from their original positions. The plastic member often breaks during this stage because a junction between the plastic member and the housing experiences a concentration of stress. The junction is a curved plane without any reinforced member mounted thereon.

Since a minimized dimension along a lengthwise direction of the connector is desired, the structures disclosed in the aforementioned applications require modification. The main body of the housing of the connector can not be changed due to the necessity for compliance with the circuit layout of the inserted module. Therefore, reducing the dimension of the latch device at either end of the housing is the only way to implement miniaturization and overcome the disadvantages of the prior art.

SUMMARY OF THE INVENTION

Accordingly, an objective of the present invention is to provide a connector with latches formed from both metal and plastic and having excellent resilience, the metal portions featuring a simple configuration for facilitating assembly to a housing of the connector.

Another objective of the present invention is to provide a connector having a stopper integrally formed on metal portions of latches thereof for limiting movement of the latches.

A further objective of the present invention is to provide a connector having latches wherein the latches are reinforced for reducing the risk of breakage thereof.

Still another objective is to provide a connector having latches which promote a minimum dimension of the connector.

Accordingly, an electrical connector in accordance with a preferred embodiment of the present invention includes an elongate insulative housing defining a central slot for receiving a module therein. A latch device is positioned at each end of the housing. Each latch device includes a plastic member integrally extending from the housing, and a metal member cooperating with the plastic member. A first plate of the metal member abuts against an outer surface of the plastic member and a first tang extends from and cooperate with the first plate for confining the plastic member therebetween. The module can be released from the connector by applying an outward force to free ends of the latch devices. A second tang extending from the first plate abuts against the plastic member when the latch device reaches its outermost position thereby preventing over-extension and breakage thereof. A third tang downwardly extending from the first plate is received in a recess defined in an outer surface of the plastic member for limiting inward movement of the latch device thereby further preventing breakage thereof.

These and additional objects, features, and advantages of the present invention will become apparent after reading the following detailed description of the preferred embodiments of the present invention taken in conjunction with the appended drawing figures.

DETAILED DESCRIPTION OF THE PREFERRED EMBODIMENT

References will now be in detail to the preferred embodiment of the invention.

Figure 1:
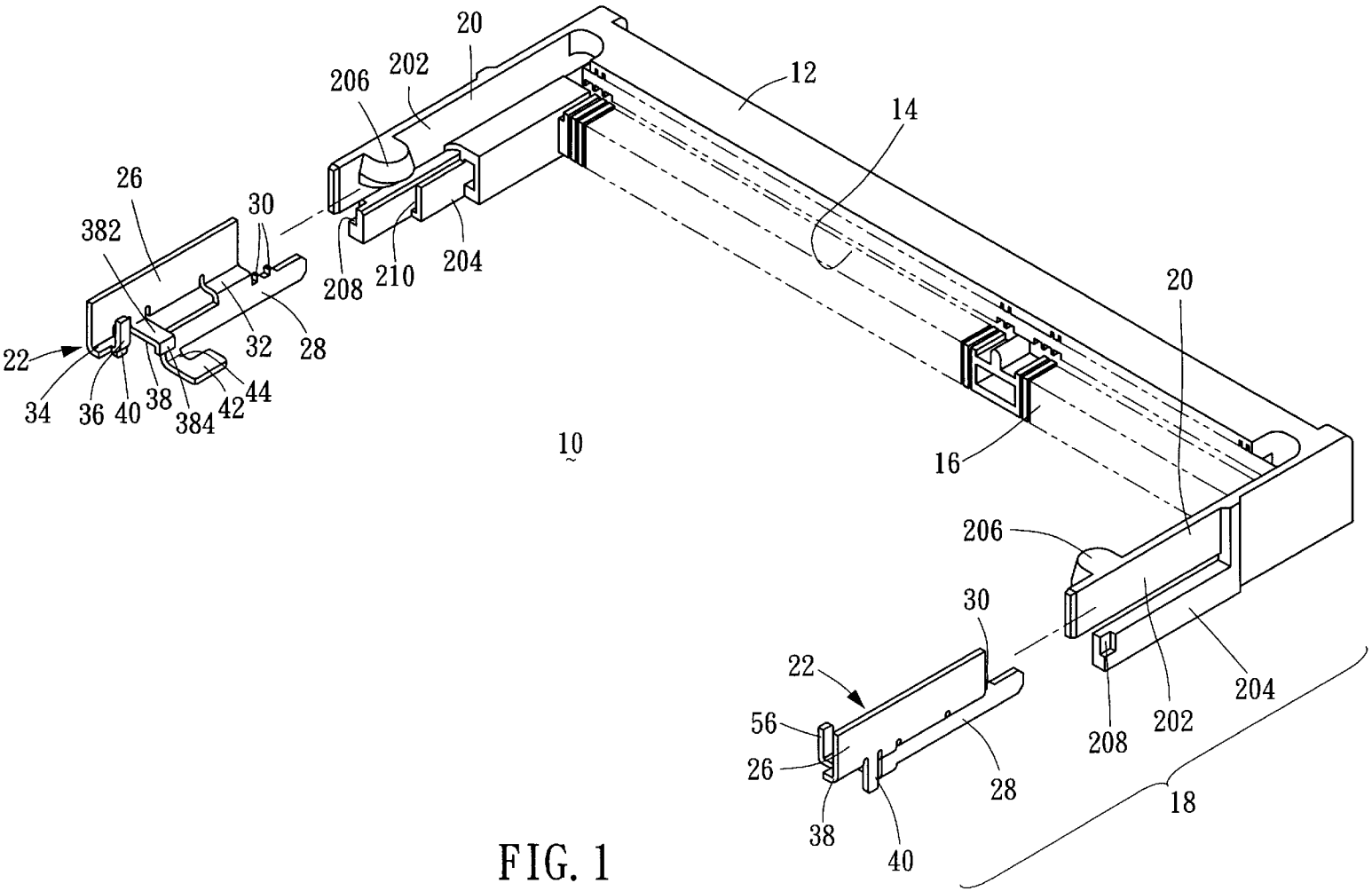
FIG. 1 is an exploded view of a preferred embodiment of an electrical connector in accordance with the present invention.
Figure 2:
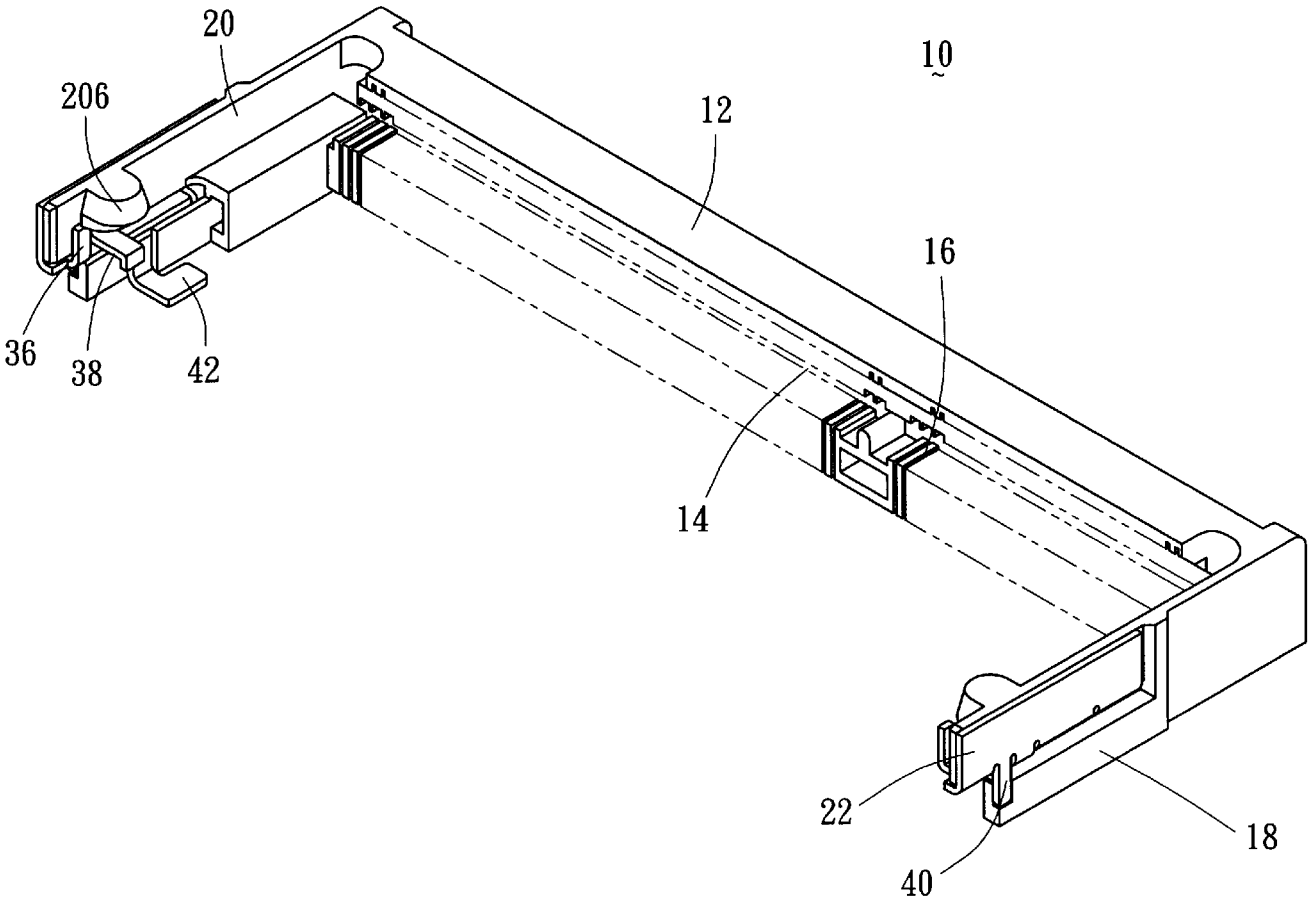
FIG. 2 is an assembled view of FIG. 1.
Figure 3:
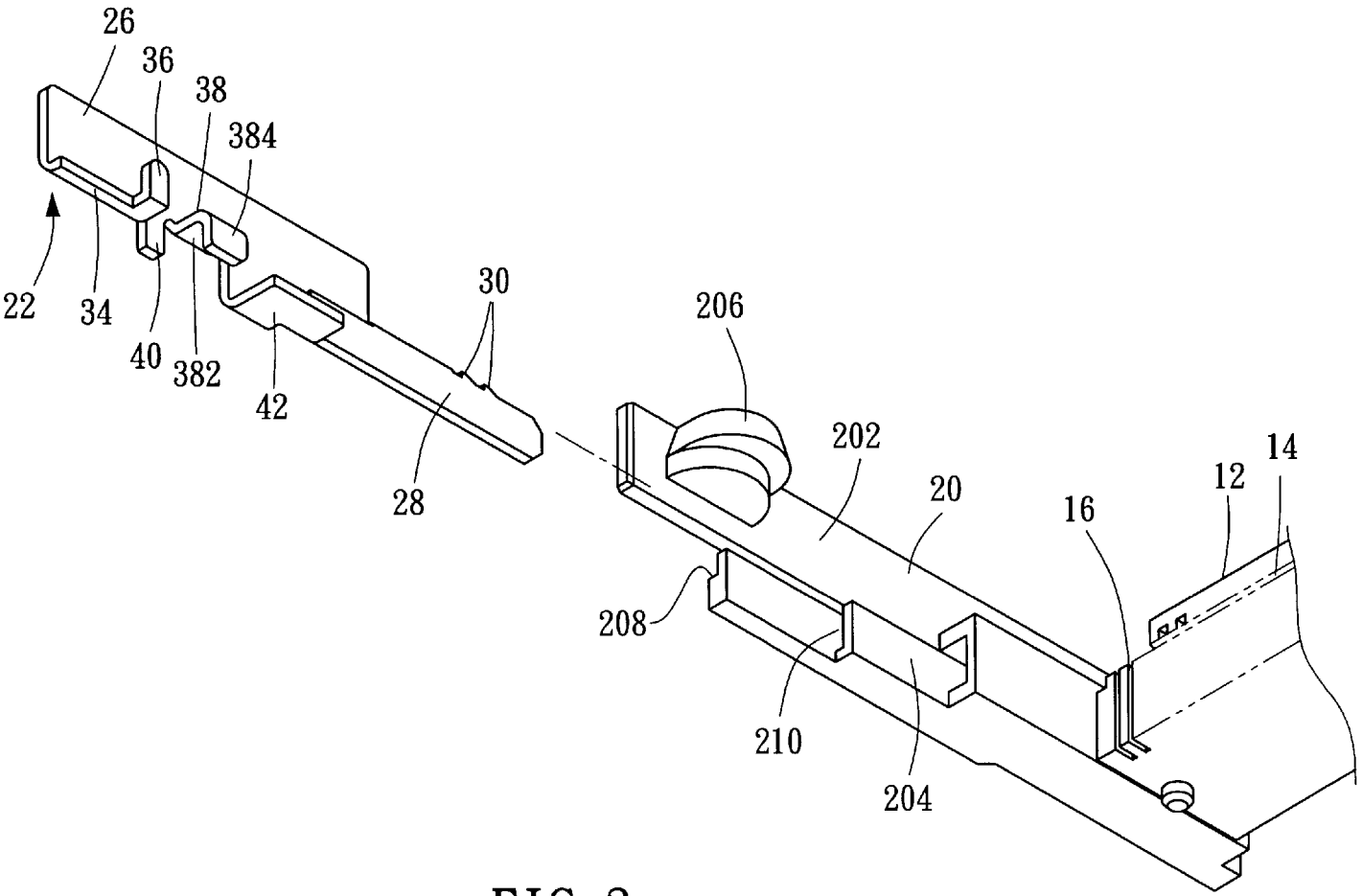
FIG. 3 is an exploded view of a latch device.
Figure 4:
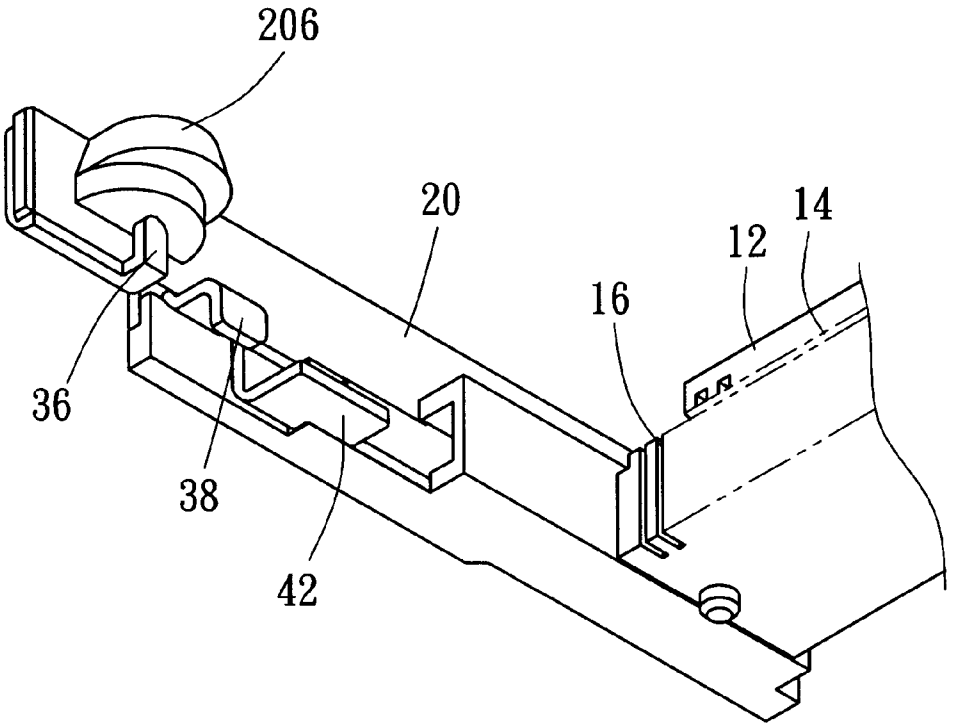
FIG. 4 is an assembled view of FIG. 3.

Attention is directed to FIGS. 1–4. An electrical connector 10 includes an elongate insulative housing 12 defining a central slot 14 for receiving a module (not shown) therein. A plurality of passageways 16 are defined in the housing 12 on opposite sides of the central slot 14 for receiving a corresponding number of contacts (not shown) whereby the contacts can electrically and mechanically engage with corresponding circuit pads formed on the module.

A latch device 18 is positioned at each end of the housing 12. Each latch device 18 includes a plastic member 20 integrally extending from the housing 12, and a metal member 22 cooperating with the plastic member 20.

The plastic member 20 includes an upper arm 202 and a lower arm 204. A locking head 206 is formed on an inner surface of the upper arm 202. A recess 208 is defined in an outer surface of the lower arm 204 at a free end thereof. A longitudinal channel 210 is defined in the lower arm 204.

The metal member 22 includes a first vertical plate 26, and a second vertical plate 28 forming barbs 30 on a front portion thereof. The first plate 26 and the second plate 28 do not lie in the same vertical plane and are substantially offset from each other by an offset section 32 integrally formed therebetween.

A horizontal bend 34 extends from a bottom edge of the first plate 26 for reinforcement thereof. A first tang 36 upwardly extends from an edge of the bend 34. An L-shaped second tang 38 having an intermediate horizontal section 382 and an end vertical section 384 extends from the bottom edge of the first plate 26. A third tang 40 downwardly extends from the bottom edge of the first plate 26 intermediate the bend 34 and the second tang 38. The second plate 28 connects to a solder pad 42 by a link 44 extending from an outermost end thereof.

In assembly, the metal member 22 is engaged with the plastic member 20 by inserting the second plate 28 into the channel 210. The provision of the barbs 30 ensures secure retention of the metal member 22 with regard to the housing 12. The first plate 26 abuts against an outer surface of the upper arm 202 and cooperates with the first tang 36 to sandwich the plastic member 20 therebetween. The third tang 40 is received in the recess 208. The solder pad 42 is assembled to a corresponding circuit pad on a PC board (not shown) on which the connector 10 is mounted.

When the module is inserted into the connector 10, the module is retained by the locking heads 206. The module can be released from the connector 10 by applying an outward force to free ends of the latch devices 18 to disengage the locking heads 206 from the module. The second tangs 38 abut against the lower arms 204 when the latch devices 18 reach their outermost positions thereby preventing over-extension and breakage of the latch devices 18. The provision of the third tangs 40 limit inward movement of the latch devices 18 thereby further preventing breakage thereof.

In comparison with the copending parent application, the invention provides a restraint means, i.e., the third tang 40 incorporating the immovable arm 204 for preventing excessive inward deflection of the plastic member 20, other than the second tang 38 incorporating the same immovable arm 204, which has been disclosed in the parent application, for preventing excessive outward deflection of the plastic member 20. Therefore, the invention assures that the plastic member 20 is guaranteed to moved within the predetermined safe range in both the inward and outward directions, which is better than the parent application only concerning about along the outward direction.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this field are to understand that all such equivalent structures are to be included within the scope of the following claims.

I claim:

1. An electrical connector comprising:

an elongated insulative housing defining a central slot for receiving a module therein and a plurality of passageways on opposite sides of the central slot;

a plurality of contacts received in the passageways;

a pair of latch devices provided at opposite ends of the housing, each latch device including a plastic member and a metal member cooperating with the plastic member;

said plastic member integrally extending horizontally from the housing, including an upper arm and a lower arm; and said metal member including a first vertical plate abutting against an outer side of the upper arm of the plastic member, and a second vertical plate retaining the metal member in position with regard to the housing, and a tang downwardly extending from the first plate;

wherein the tang abuts against the lower arm of the plastic member when the upper arm of the latch device with the first vertical plate is inwardly resiliently moved inward after releasing the module, thereby limiting excessive inward deflection of and preventing breakage of the latch device.

2. The connector as described in claim 1, wherein a recess is defined in an outer surface of the lower arm at a free end thereof for receiving the tang therein.

3. A metal member of a latch device for engaging with a plastic member integrally extending form a housing of a connector, comprising:

a first vertical plate for abutting against an outer surface of the plastic member, and a horizontal bend extends from a bottom edge of the first plate for reinforcement thereof, and a second vertical plate received in a channel defined in the plastic member for retaining the metal member in position with regard to the housing, and a tang extending from the first plate;

wherein the tang abuts against the plastic member when a free end of the latch device is moved inward thereby limiting movement and preventing breakage of the latch device.

4. The metal member as described in claim 3, wherein a recess is defined in the plastic member for receiving the tang.

5. The metal member as described in claim 3, wherein another tang upwardly extends from an edge of the bend for positioning the first plate to the plastic member.

6. The metal member as described in claim 3, wherein the second vertical plate forms barbs on a front portion thereof for ensuring secure retention of the metal member with regard to the housing.

7. The metal member as described in claim 3, wherein the first plate and the second plate do not lie in the same vertical plane, and are substantially offset from each other by an offset section integrally formed therebetween.

8. The metal member as described in claim 3, wherein an L-shaped tang having an intermediate horizontal section and an end vertical section extends from the bottom edge of the first plate for abutting against the plastic member when the latch device is moved outward thereby preventing over-extension and breakage thereof.

9. An electrical connector comprising:

an elongated insulative housing defining a central slot for receiving a module therein and a plurality of contacts positioned beside said central slot;

a pair of latch devices provided at opposite ends of the housing, each latch device including a plastic member and a metal member cooperating with the plastic member;

said plastic member integrally extending horizontally from the housing, including an immovable arm and a movable arm; and said metal member including a lower vertical plate retaining the metal member in position, and a tang downwardly extending from another upper vertical plate of the metal member and abutting against the immovable arm of the plastic member as soon as the movable arm with said upper vertical plate is inwardly resilient moved after releasing the module, for preventing inward over-extension of the plastic member.

10. The connector as described in claim 9, wherein said metal member further includes another tang adapted to abut against the same immovable arm for limiting outward movement of the plastic member.

11. The connector as described in claim 10, wherein the metal member further includes another vertical plate abutting against an outer surface of the plastic member, and both said tangs extend therefrom.

12. The connector as described in claim 11, wherein the metal member further includes an additional tang to cooperate with said another vertical plate for confining the plastic member therebetween.

13. An electrical connector comprising:

an elongated insulative housing defining a central slot for receiving a module therein and a plurality of contacts positioned beside said central slot;

a pair of latch devices provided at opposite ends of the housing, each latch device including a plastic member and a metal member cooperating with the plastic member;

said plastic member integrally extending horizontally from the housing, including an immovable arm and a movable arm; and said metal member including a first tang means for linking the metal member and the plastic member together, an L-shaped second tang means for preventing outward over-extension of the plastic member, and a third tang means for preventing inward over-extension of the plastic member.

14. The connector as described in claim 13, wherein all said three tang means extend from a same vertical plate which abuts against an outer surface of the plastic member.

15. A metal member of a latch device for engaging with a plastic member integrally extending form a housing of a connector, comprising:

a first vertical plate for abutting against an outer surface of the plastic member, and a second vertical plate received in a channel defined in the plastic member for retaining the metal member in position with regard to the housing, a link extending from an outermost end of the second plate connects to a solder pad which is assembled to a corresponding circuit pad on a PC board on which the connector is mounted, and a tang extending from the first plate;

wherein the tang abuts against the plastic member when a free end of the latch device is moved inward thereby limiting movement and preventing breakage of the latch device.

* * * * *